US007124544B2

(12) United States Patent
Brown et al.

(10) Patent No.: US 7,124,544 B2
(45) Date of Patent: Oct. 24, 2006

(54) PREFABRICATED MULTI-PURPOSE SUPPORT BLOCK FOR USE WITH I-JOISTS

(75) Inventors: Comer Brown, Boise, ID (US); Lawrence Brown, Boise, ID (US)

(73) Assignee: Silpro, LLC, Boise, ID (US)

( * ) Notice: Subject to any disclaimer, the term of this patent is extended or adjusted under 35 U.S.C. 154(b) by 498 days.

(21) Appl. No.: 10/376,578

(22) Filed: Feb. 27, 2003

(65) Prior Publication Data

US 2003/0159367 A1 Aug. 28, 2003

Related U.S. Application Data

(60) Provisional application No. 60/360,726, filed on Feb. 27, 2002.

(51) Int. Cl.
*E04B 1/00* (2006.01)

(52) U.S. Cl. ..... 52/264; 52/69; 52/611

(58) Field of Classification Search ..... 52/729.2, 52/729.4, 702, 289, 690, 69, 611
See application file for complete search history.

(56) References Cited

U.S. PATENT DOCUMENTS 1,377,891 A * 5/1921 Knight ..... 52/730.7
2,332,052 A * 10/1943 Brent ..... 52/578
3,960,637 A * 6/1976 Ostrow ..... 156/293
4,070,845 A * 1/1978 Cody ..... 52/632
4,336,678 A * 6/1982 Peters ..... 52/729.4
4,423,977 A * 1/1984 Gilb ..... 403/232.1
4,815,243 A * 3/1989 Pardo ..... 52/100
4,947,612 A * 8/1990 Taylor et al. ..... 52/693
6,209,282 B1 * 4/2001 Lafrance ..... 52/729.1
6,497,080 B1 * 12/2002 Malcolm ..... 52/731.7

OTHER PUBLICATIONS

Trus Joist™ pamphlet showing building techniques with explanation by Applicant's Agent of 'Web Stiffener Attachment' (p. 7 of pamphlet), Jul. 2001.
Connector Selection Guide by Boise Cascade Timber and Wood Products Division, Jun. 2000.

* cited by examiner

*Primary Examiner*—Kimberly Wood
(74) *Attorney, Agent, or Firm*—Pedersen & Co., PLLC; Ken J. Pedersen; Barbara S. Pedersen

(57) ABSTRACT

A multi-purpose, shaped, prefabricated, structurally-enhancing support block conforms to the side profiles of conventional I-joists. The support block is preferably installed by fastening it to the I-joist web, rather than to the I-joist flanges, thus preserving the integrity of the I-joist flanges. Further, support blocks may be used in mid-span where additional point-load support is needed, or at joist ends for additional load bearing and/or enhanced rim board, attachment and nailing capabilities. The preferred support block includes a load-jack portion for bearing compressive load and a web and flange support portion reinforcing the thin web of an I-joist to help prevent buckling, rolling, or twisting of the I-joist under peak load conditions.

16 Claims, 6 Drawing Sheets

PREFABRICATED MULTI-PURPOSE SUPPORT BLOCK FOR USE WITH I-JOISTS

This application claims priority of provisional application Ser. No. 60/360,726, filed Feb. 27, 2002, entitled "Prefabricated Multi-Purpose Support Block for Use with Manufactured I-joists, the disclosure of which is incorporated herein by this reference.

BACKGROUND OF THE INVENTION

1. Field of the Invention

This invention relates to a preferably prefabricated, pre-cut, shaped, milled and profiled structural block that is preferably universally compatible with all existing and preferably all future I-joist manufactured products. The preferred design of the invented support block generally conforms to the side profile of an I-joist, providing added support, reinforcement, nailing surface, bearing area, and protection of the integrity of the I-joist. It may be used at load-bearing points where additional support is required, and/or at joist ends where an increased end-surface area is needed to: a) comply with code specified nailing schedules for attaching I-joists to plates; or b) secure rim boards and trim components to I-joists. This invention may be one component in a continuing, expandable series of products that comprise an I-joist enhancement system, to be used in frame construction projects utilizing I-joists.

2. Description of the Related Art

Several large companies throughout the U.S. manufacture I-joist floor joists and roof rafters for use in frame building construction. According to manufacturers, the advantages of such joists include: a) lightweight for ease of handling, b) product uniformity and consistency, c) availability of long lengths, d) high structural integrity, e) economically competitive, and f) the conservation of old-growth forests through use of composite wood fiber materials.

I-joists are comprised of top and bottom flanges made of solid wood, laminated veneer lumber (LVL) or Oriented Stand Lumber (OSL) with a thin center web between the flanges made of plywood or oriented strand board (OSB) or other structurally approved materials. While these products are well engineered for uniformly distributed top load conditions, the thin web creates unique challenges for concentrated point loads and end-nailing. I-joist manufacturers publish details for conventional vertical solid wood "squash blocks" to be used on either side of joists for additional support. However, there is an absence of specific nailing instructions and details for securing these blocks. Many of these solid wood blocks tend to split at the ends when nailed. Also, potential exists for field error in cutting these blocks square and to correct length. Error can render the blocks useless. Further, there is potential for damage to the structural integrity of I-joists if squash blocks are improperly nailed to the flanges. Most manufactures allow only one (1)16d box nail sideways into the flange every 4" to 6" of flange length, thus making it difficult to position and adequately secure squash blocks to opposite sides of an I-joist. Additionally, sideways nailing into the flange is prohibited, in most instances, within 3" to 4" from the end of an I-joist. This makes block installation difficult near the perimeter rim board. Incorrect nailing can result in serious structural damage that can result in diminished performance or failure of the I-joist.

Another potential for improper nailing occurs where the end of an I-joist bears on a plate. Code-approved nailing schedules often require a minimum of three (3)8d box nails to secure a joist to a plate. This is impossible when I-joists connect to a standard rim board on a 2×4 plate, and difficult when the I-joists connect to a rim board on a 2×6 plate. Most manufacturers require the first nail be at least 1½" from the end of the joist. The second nail is usually offset at least ½" from the first nail or 2" min. away from the end of the joist on the opposite side of the web. The third nail must be at least 2" away from the first nail, thus locating it 3½" to 5¼" (min.) from the outside edge of the plate, depending on thickness of the rim board and any set-back for sub-siding and/or wall shear panels. This third nail completely misses a 2×4 plate, and potentially only penetrates a 2×6 plate on its very edge.

Therefore, a need exists for a versatile product that provides structural enhancements to the thin web of an I-joist, additional bearing support where required, and improved nailing capabilities.

BRIEF SUMMARY OF THE INVENTION

An objective of the invented support block is to provide a specially-adapted support block generally conforming to the side profile of an I-joist, for providing added support, reinforcement, nailing surface, bearing area, and protection of the integrity of the I-joist. Preferably, the invented support block is a structural wood reinforcing component, and is pre-cut, shaped, and machined to be form-fitting against the I-joist/rafter, so that little or preferably adaptation needs to be done at the construction site. The support block may be made from solid or reconstituted wood and/or other approved composite materials, and preferably by design conforms to all sizes and dimensions of I-joists. Another objective of the support block is that it assists installers in maintaining the integrity of I-joist flanges by helping them protect the flanges from degradation that occurs due to poor and/or improper nailing during installation. Further, the invented support block may reduce potential field installation problems, and therefore may reduce the time and expense of confrontational inspections between code officials, builders, engineers and I-joist representatives resulting in higher customer satisfaction and lower expense. Therefore, an overall objective is to provide a support block that is an easy-to-use, cost-effective, engineered product that compliments and improves the overall performance of an I-joist floor or rafter system.

The preferred support block comprises a load-jack portion for increased compressive load capacity and a web and flange support to help prevent buckling, rolling, or twisting of the I-joist under peak load conditions. The web and flange support may have preferred machined edges (corners) that are adapted to avoid inference with glue that often exudes from between the flanges and web of conventional I-joists and solidifies.

The invented support blocks may be used on one or both sides of an I-joist. Once the invented support blocks are installed, additional solid wood "squash blocks" may be added without harming the I-joist. The support block may act as a nailing platform to receive nails required to secure any additional blocking.

Besides the structure-enhancing benefits, support blocks may simply be conveniently used at joist ends to create an expanded area for nailing rim joists or sub-fascias. This is particularly useful when I-joists are used for roof rafters and there is need for a more solid connection of the roof-eave sub-fascia onto the rafter ends. A nailed or stapled and optionally glued-in-place secured support block on the end of a rafter tail provides a solid nailing surface for attaching roof eaves, fascias and trim.

DETAILED DESCRIPTION OF THE PREFERRED EMBODIMENTS

Referring to the Figures, there are shown some, but not the only, embodiments of the invented support block and methods of using the same. The preferred support block, currently called the "Speed-I-Lock™" Support Block, is adapted to form-fit against an I-joist, so that the face of the support block has the general profile of an I-joist all the way from the top edge to the bottom edge of the I-joist. This device will preferably be used by framers to provide additional support and improved nailing capabilities to I-joists. The device may also be used to afford greater surface area at joist ends when required for end nailing assignments.

The preferred support block provides additional compressive point load capacity, increases lateral stability to an I-joist web, provides improved nailing capabilities, and assists in maintaining the integrity of the I-joist flanges. Additionally, it is easy to use, saves time and installation costs in the field. This product when properly nailed or stapled in place to the joist web and not to the flange provides significant improvements to a building system using I-joists. An application option is the additional use of an approved sub-floor adhesive on the contact surfaces between the support block and the I-joist, which further compliments overall performance of the installation.

The support block may be made available for, but not limited to: 9½", 11⅞", 14", and 16" deep "I-joists", with 1½", 1¾", 2", or 2 9/16" wide top and bottom flanges. The support block may be produced in varied sizes and out of various material types to create different performance standards and to meet specific industry and market needs. Support blocks may be manufactured in various widths to accommodate different bearing wall/plate widths. Additionally, angled end cuts of 45, 30, and 22.5 degrees are preferably utilized to conform the support block to various angles of connecting rim boards.

Figure 3:
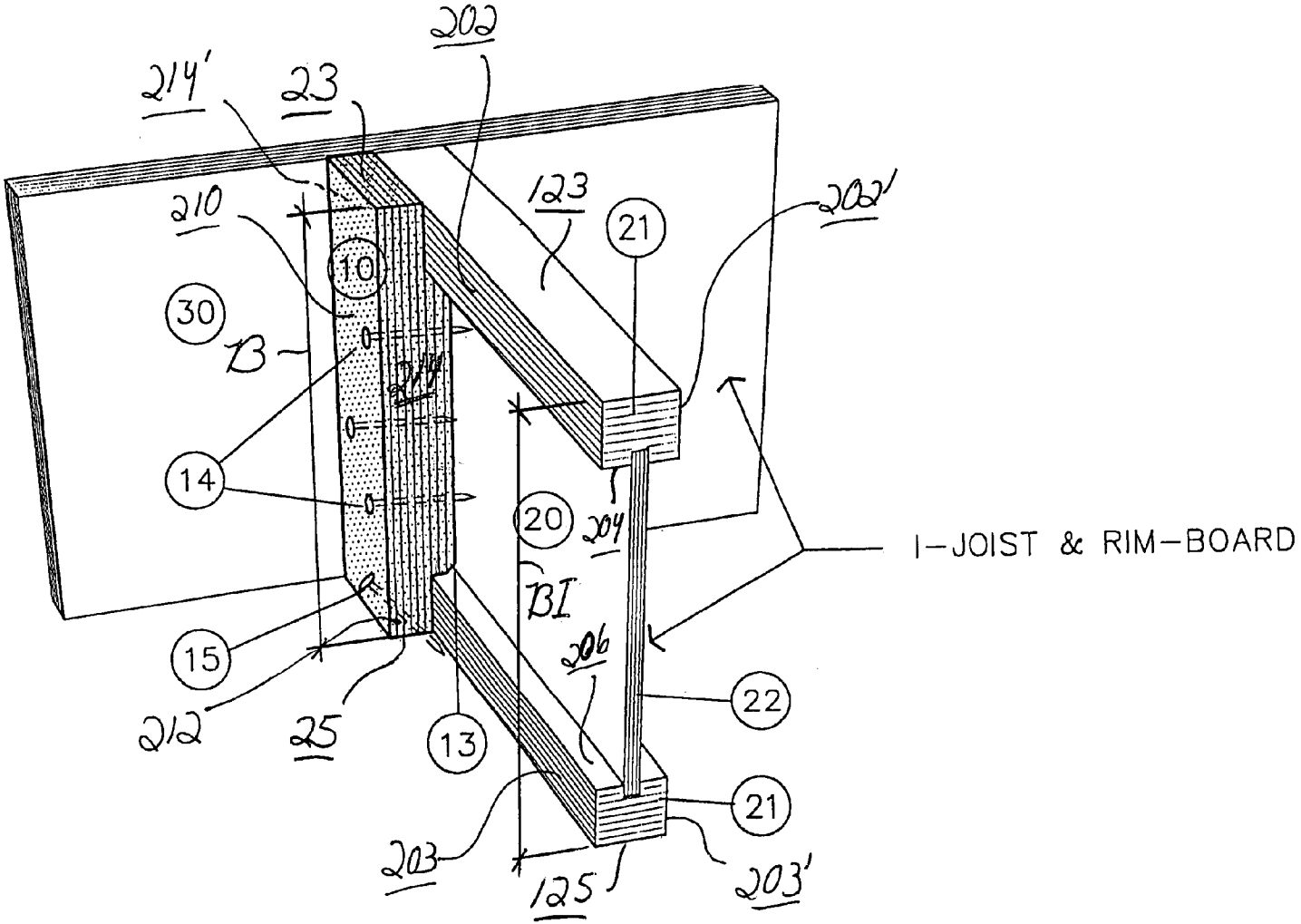
FIG. 3 is a perspective view of an invented support block installed at the typical perpendicular connection of an I-joist to a rim board.

The invented support block comprises a "Load-Jack" portion 11, which is squarely cut preferably to be exactly the same depth (dimension B in FIGS. 1 and 3) as the depth of the accompanying I-joist or not more than 1/16 inch greater depth than the I-joist depth, wherein "I-joist depth" means the dimension from the top surface of the top flange to the bottom surface of the bottom flange of the I-joist (dimension BI in FIG. 3). The support block should not be cut to less depth than the I-joist depth (that is, should not be cut so that B is less than BI), as this would result in the installed support block not possessing any load-bearing capacity. Because the support block(s) rest beside the I-joist, typically on the plate, the bottom surface 25 of the support block will be flush with the bottom flange bottom surface 125, and the top surface 23 of the support block will be flush with the I-joist top surface 123 or very slightly (but preferably not more than 1/16$^{th}$ inch) above the top surface 123.

Preferably, the load-jack portion 11 bears the majority of the compressive load, which is transferred to it through the conventional sub-floor directly above the support block and the I-joist (not shown) and by virtue of the support block and the I-joist preferably resting on a conventional plate (also not shown). Also, it can receive additional nails which may be required for a joist connection, thereby reducing risk from improper and/or excessive nailing into the I-joist flanges. A properly installed support block becomes an integral part of an I-joist so that it can be nailed directly through to the plate to help meet nailing requirements of securing the joist to the plate. For load-jack portions comprised of solid wood or composite wood products, a vertical grain orientation, that is, parallel to the transverse dimension of the I-joist, may be specified for increased compressive load capacity.

Also, a support block comprises a "Web and Flange Support" portion 12 that is attached to and reinforces the thin web of an I-joist, helping prevent buckling, rolling, or twisting of the I-joist under peak load conditions. This web and flange support portion 12 is preferably about 1/16" shorter (dimension C in FIG. 1) than the inside distance between the I-joist flanges to prevent inappropriate forces being placed on the flanges, and hence, to protect the integrity of the I-joist glue joints between the flanges and the web. The web and flange support portion preferably has machined edges 12 to allow room for an appropriate fit in the presence of irregular glue beading that may occur in the I-joist manufacturing process between the I-joist flange and the I-joist web. The vertical dimension of the web and flange support is less than the load-jack, thus creating flange notches 19 near the top and bottom machined edges (12). The entire support block may be machined or milled from a single solid block or from two or more components laminated together.

Figure 1:
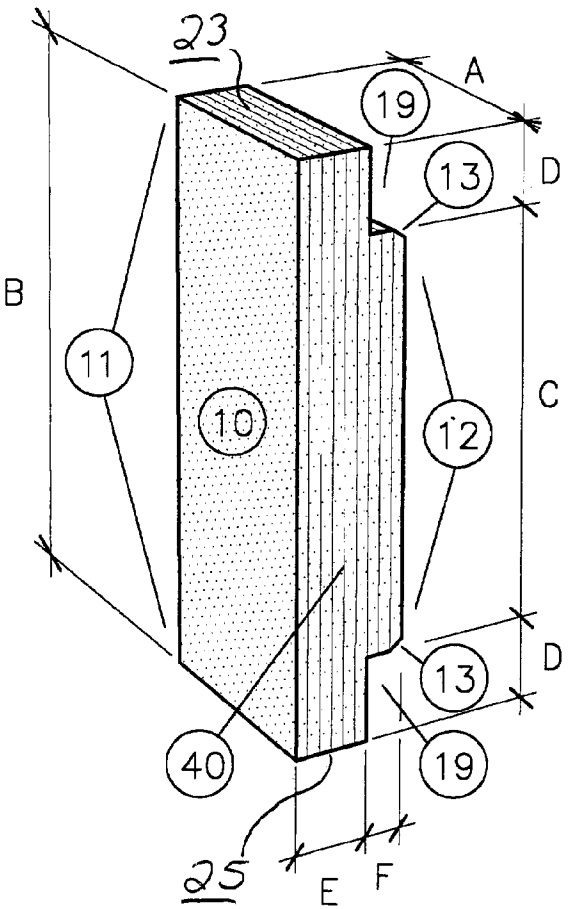
FIG. 1 is a detailed perspective view of one embodiment of an invented support block with standard square-cut ends, demonstrating its desired attributes.

FIG. 1 demonstrates the preferred basic form and dimensions of the preferred support block. The preferred support block 10 is a profile-fitting, multi-purpose, prefabricated, shaped and/or milled, single and/or laminated structural block dimensioned to fit various sizes of I-joists. Lamination may be preferred when composite wood fiber materials are utilized. The "load jack" 11 bears the majority of the compressive load. The "web and flange support" 12 attaches to and reinforces the thin web of an I-joist. The flange notches 19 are milled and/or machined to conform to the I-joist flanges. Upper and lower edges (corners) 13, which are preferably machined, on the web and flange support allow for an appropriate fit of the support block, even in the presence of irregular glue beading that may occur in the manufacturing process of the I-joist between the I-joist flange and web. This way, the edges 13 are not sharp corners that might abut against a glue bead or other material and exert unwanted force on that material and on the flanges that might work to loosen the flanges from the web. The term "machined" edges 13 means that the edges 13 are reduced/removed from what they would be if the surfaces of the web and flange support portion extended to meet at 90 degrees. The term "machined" edges 13 refers to edges that are rounded, beveled, eased, or otherwise reduced to be out of the way of glue that has exuded and solidified out of the joint between the web and the flanges of the I-joist. Vertical orientation of wood fibers 40, that is parallel with the length extending between the top surface 23 and the bottom surface 25, is generally preferred for greater compressive load capabilities.

Figure 2:
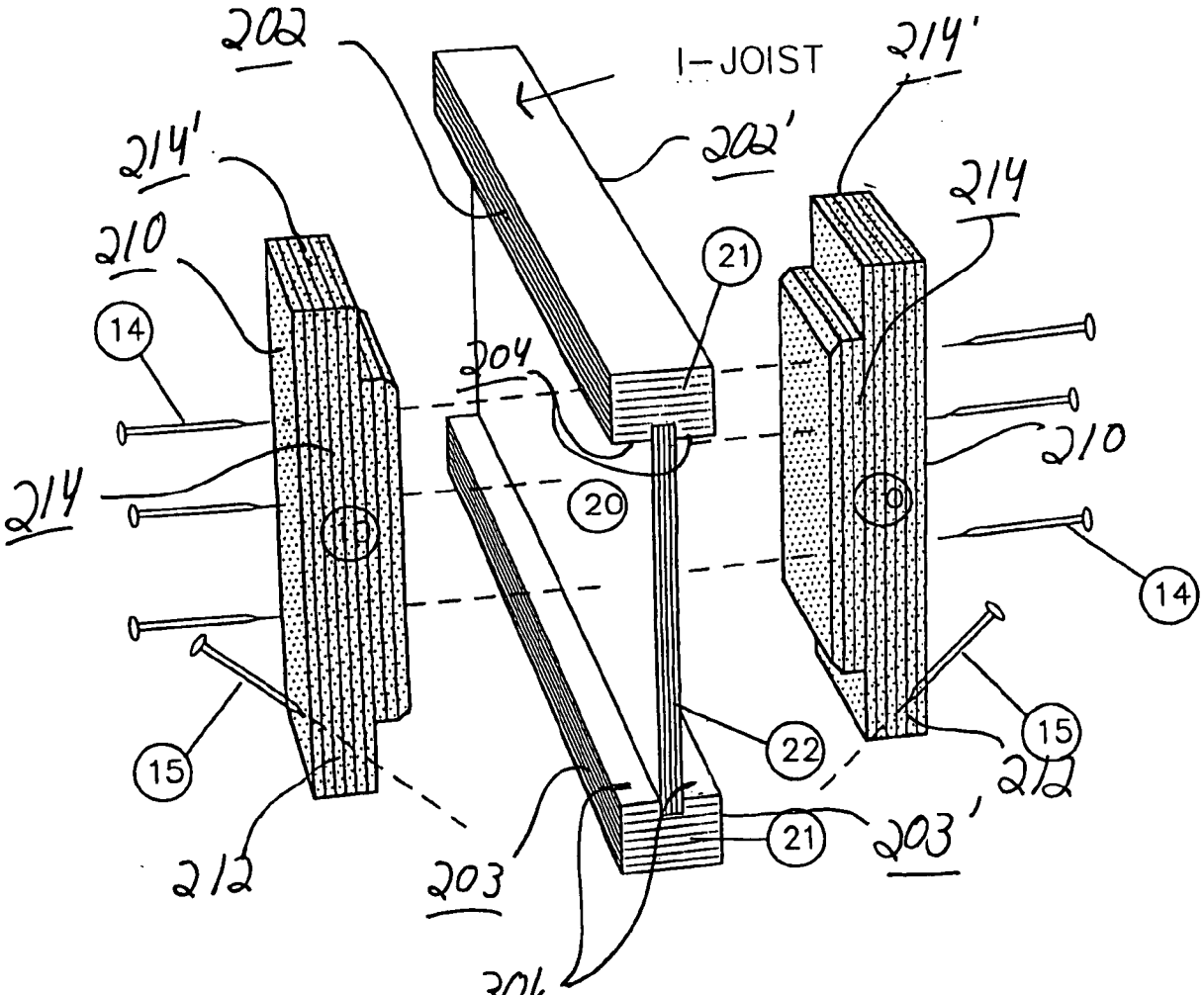
FIG. 2 is an exploded perspective view of how standard square-cut profile fitting Support Blocks conform to a typical I-joist.

FIG. 1 Note:

A=Varies (3½" to 7¼" preferred)
B=Matching I-joist depth plus up to 1/16"
C=Matching web depth minus 1/16" (preferred)
D=Matching flange depth plus 1/16" (preferred)
E=Varies (⅝" to 1¼" preferred)
F=Varies according to I-joist flange and web width FIG. 2 shows how the preferred support block 10 design conforms to a typical I-joist 20. Support blocks are secured to an I-joist with nails 14 or staples into and through the I-joist web 22, and not the I-joist flanges 21. Sub-floor adhesive is recommended along contact surfaces, such as the inner surface of the web and flange support portion 12 (see FIG. 1) and the inner surface of the load-jack portion 11 (see FIG. 1). Once support blocks are attached to the I-joist, the blocks become an integral part of the joist, and can be toe nailed, for example via nails 15, for attachment to a plate below. Since improper or over-nailing into the flanges 21 can result in serious structural damage, it is apparent that by not nailing into the flanges at all, the integrity of the I-joist is preserved.

FIG. 3 shows the connection of an I-joist 20 to a perpendicular rim board 30. When secured by nails 14 into the I-joist web 22, a support block 10 enhances this connection by providing; a) additional bearing capacity to the end of the joist; b) greater surface nailing area for securing the rim board to the end of the joist; and c) extra toe nailing 15 capability to secure the assembly to a plate below without further nails into the I-joist flange 21.

As shown to best advantage in FIGS. 2 and 3, the I-joist 20 flanges each have outer side surfaces 202, 202', 203, 203' which are the outermost side extremities of the I-joist. Further, the top flange has an underside 204, and the bottom flange has a topside 206. The support block 10 has an outer surface 210, a bottom region 212, and end surfaces 214, 214'. The I-joist end surfaces 225, 225' are of an "I-shape."

Figure 4:
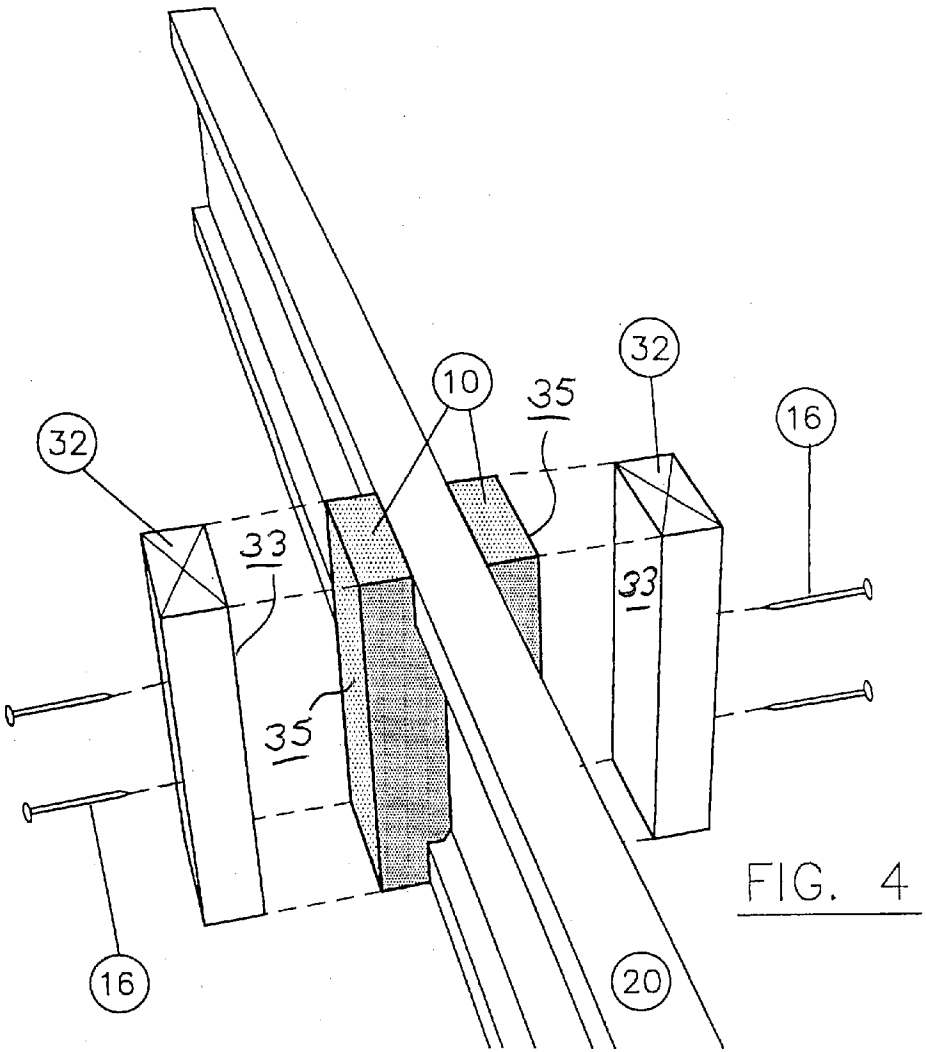
FIG. 4 is a typical exploded perspective view of how solid wood frame "squash blocks" may be attached to the invented support blocks.

FIG. 4 illustrates how additional solid wood frame "squash blocks" 32 can be used in conjunction with the invented support blocks 10. The squash blocks 32 may be substantially rectangular blocks with flat planar inner faces 33 that abut against the outer preferably flat planar surfaces 35 of the support blocks 10. Once support blocks have been secured to an I-joist 20, they create a nailing platform for nails 16 needed to secure any additional "squash blocks". In this way, the designer/builder may employ as much bearing surface area as may be required to adequately support the load above.

Figure 5:
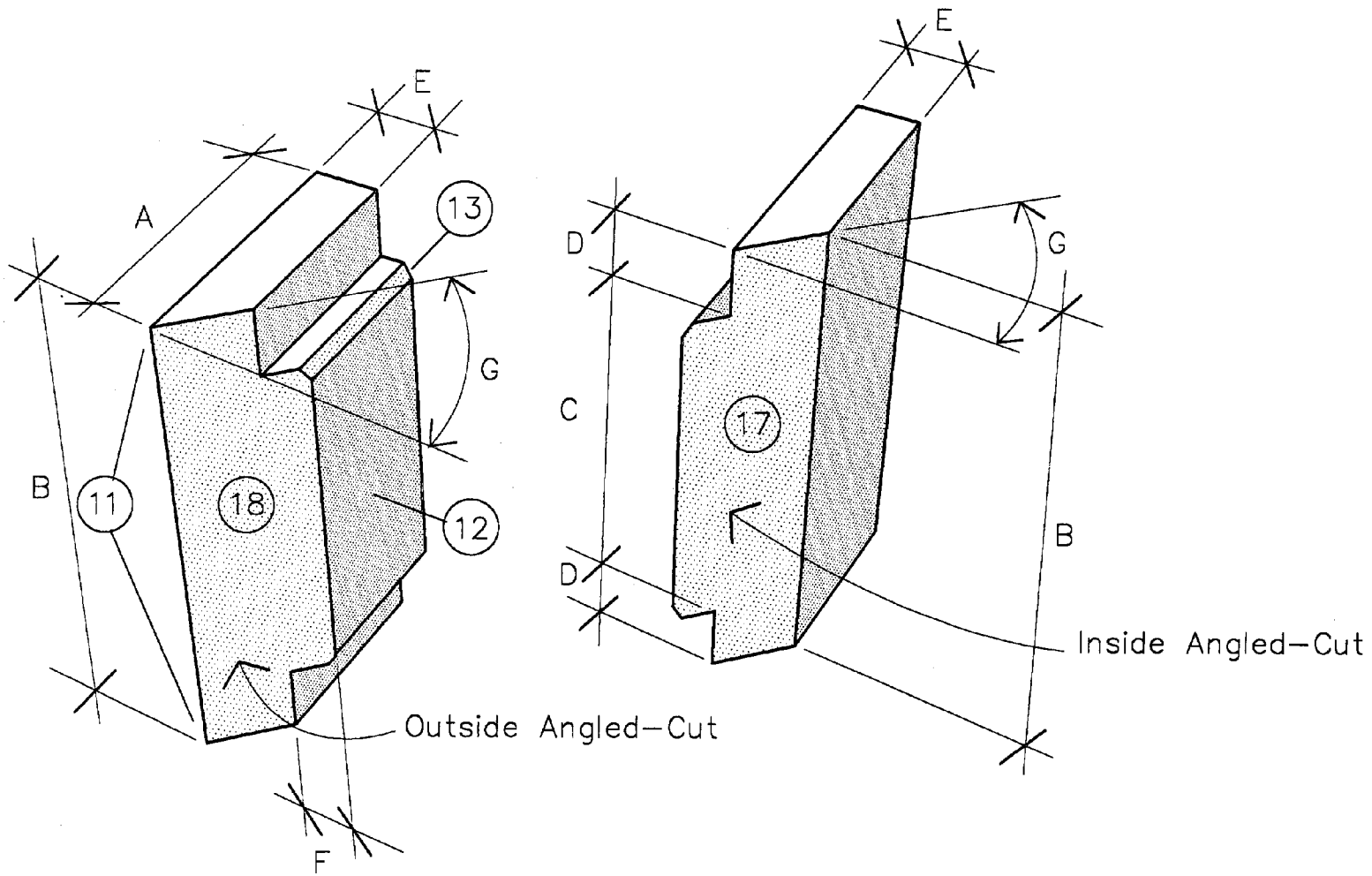
FIG. 5 is a detailed perspective view of the embodiments of form fitting Support Blocks with optional angled ends (45, 30, and 22.5 degrees preferred) to demonstrate their desired attributes.

FIG. 5 demonstrates the basic form and dimensions of support blocks according to another embodiment of the invention that have been angle cut 17, 18 on the ends so as to match a rim board that is not perpendicular to the I-joists. A support block with an "outside angled-cut" 18 extends the desired angle beyond the end of the I-joist so that a flat surface contact can be made with the accompanying angled rim board. An "inside angled-cut" 17 extends the flat surface contact area back toward the joist itself. Note that angled support blocks have many of the same attributes as the standard square-cut blocks, including the "load jack" 11, the "web and flange support" 12, and the machined edges 13, whereas the differences are the outside dimensions A, due to the angled cuts G on the edges of the block.

FIG. 5 Note:

A=Varies (3½" to 7¼" preferred)
B=Matching I-joist depth plus up to 1/16"
C=Matching web depth minus 1/16" (preferred)
D=Matching flange depth plus 1/16" (preferred)
E=Varies (⅝" to 1¼" preferred)
F=Varies according I-joist flange and web width
G=Varies (45, 30 and 22.5 degrees preferred)

Figure 6:
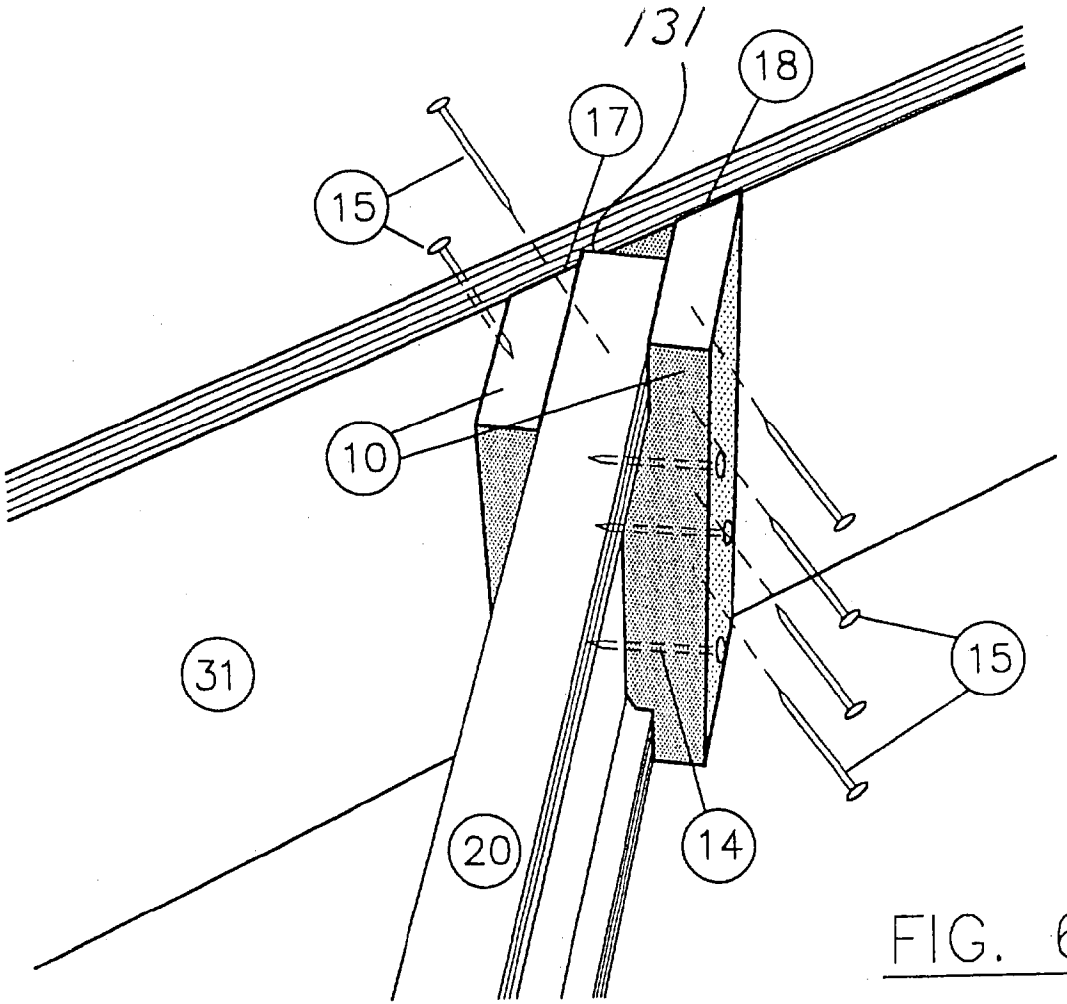
FIG. 6 is a typical perspective view of invented optional angled support blocks installed at the connection of an I-joist to an angled rim board.

FIG. 6 shows how invented support blocks 10 relate to a typical I-joist 20 that connects to an angled rim board 31. Once support blocks have been nailed 14 to the I-joist web, the assembly can be nailed 15 to the angled rim board. Nailing 15 can be from inside or outside the rim board, depending on orientation and accessibility created by the inside 17 or outside 18 angled cut on the support block. The rim board of FIG. 6 includes recesses (one recess shown at 131) in its front surface adapted to receive and laterally stabilize the end of the I-joist, according to one embodiment of a companion modular rim board. The invented rim board recessed receptacles may be machined to receive I-joist ends so that the I-joist extends at 90 degrees to the front surface of the rim board, or at an angle as represented by FIG. 6.

The preferred support block is a single, unitary and integral block of solid or veneered, laminated, reconstituted, or composite material. By "unitary" and "integral" is meant that preferably the unitary, integral support block is formed from a single piece of material. Alternatively, however, support blocks according to the invention may not be integral and may not be a single unitary piece, as they may be made from two or more pieces of material that have been nailed, stapled, and/or glued and/or otherwise fastened together. Also, although the preferred embodiments of support blocks have no moving parts and no externally attached hardware, alternative embodiments are not so-limited.

Support blocks may be manufactured, for example, from solid softwood and/or hardwood lumber; laminated wood veneers; reconstituted composite wood products using various types and/or combinations of adhesive bonding systems. Support blocks may be formed, for example, by extruding and/or platen pressing wood particles, fibers, strands, chips, flakes; composites such as plastics, acrylics, fiberglass, nylons, and other synthetic fibers or materials in various forms and/or in combinations that can be used to create strong and durable products that will meet stated and evolving industry performance standards.

One or two support blocks may be preferred for placement on one or both sides of an I-joist, depending on the design load. Preferably, two support blocks on the two sides of the I-joist are substantially identical, so that the compressive loads of the two blocks are approximately double of a single block. Support blocks on both sides of the I-joist may be required due to the design load created by multiple floors of a building.

Although this invention has been described above with reference to particular means, materials and embodiments, it is to be understood that the invention is not limited to these disclosed particulars, but extends instead to all equivalents within the scope of the following claims.

What is claimed is:

1. A support system for floor and rafter joists comprising an I-joist and support block assembly:

the I-joist consisting of a top flange with a top surface and a top flange outer side surface and a bottom flange with a bottom surface and a bottom flange outer side surface and a web connecting and extending between the top and bottom flanges and having a web side surface, and the I-joist having a depth dimension from the top surface to the bottom surface and the I-joist having an I-joist side surface comprising a said top flange outer side surface, said web side surface, and said bottom flange outer side surface, wherein said top flange outer side surface and said bottom flange outer side surface are outermost side extremities of the I-joist; and a one-piece said support block adapted to contact said I-joist side surface, the support block having a support portion with an inner surface adjacent to said web and fitting between the top flange and the bottom flange, and a load-bearing portion extending out from the support portion and extending up along the top flange outer side surface to a plane at or above the plane of the top surface and down along the bottom flange outer side surface to be coplanar with the plane of the bottom surface, so that the load-bearing portion is adapted to increase compressive load capacity of the I-joist and support block assembly.

2. A support system as in claim 1, wherein said support portion has an upper edge near a joint between the top flange and the web, and a lower edge near a joint between the bottom flange and the web, and wherein the upper edge and the lower edge are machined so that said edges are out of the way of said joints.

3. A support system as in claim 1, wherein said load-bearing portion has a topmost surface and a bottommost surface, wherein said load-bearing bottommost surface is flush with said I-joist bottom surface and said topmost surface is in a location ranging from co-planar with said plane of the I-joist top surface up to not more than 1/16 inch above the plane of the I-joist top surface.

4. A support system as in claim 1, comprising two of said support blocks on two sides of the I-joist.

5. A support system as in claim 4, comprising nails extending through said support blocks and into said web.

6. A support system as in claim 4, comprising nails extending through said support blocks and into said web and not into said top and bottom flanges.

7. A support system for joists in a floor or rafter system, the support system comprising an I-joist and at least one support block, the I-joist having an I-shaped end profile, and a side surface comprising a central vertical web with a top edge and a bottom edge, a top flange protruding laterally out from said web top edge and having a top flange outermost side extremity and a bottom flange protruding laterally out from said web bottom edge and having a bottom flange outermost side extremity, and the support block being a unitary piece comprising an integral central portion and load-bearing portion, the central portion extending to contact said web and not contacting said top flange and not contacting said bottom flange, and the outer load-bearing portion extending up along said top flange outermost side extremity and extending down along said bottom flange outermost side extremity;

wherein said support block is attached to said I-joist by one or more nails extending through the support block and into only the web, so that the support block is not nailed to the top flange and not nailed to the bottom flange.

8. A support system as in claim 7, wherein said outer load-bearing portion has a topmost surface and a bottommost surface, and said bottommost surface is co-planar with a bottom surface of said bottom flange and said topmost surface is co-planar with a top surface of said top flange.

9. A support system as in claim 7, wherein said outer load-bearing portion has a topmost surface and a bottommost surface, and said bottommost surface is flush with a bottom surface of said bottom flange and said topmost surface is not higher than 1/16 inch above a top surface of said top flange.

10. A support system as in claim 7, wherein said central portion has an upper edge and a lower edge which are machined to avoid contact with joints between said top flange and the web and between the bottom flange and the web.

11. A support system as in claim 7, further comprising glue that has exuded and solidified out of joints between the web and the flanges of the I-joist, and wherein said central portion has a top edge and a bottom edge that are reduced to be out of the way of said glue.

12. A support system as in claim 7, wherein said top flange has an underside and said bottom flange has a topside spaced apart from each other a distance, said central portion of the support block has an upper surface and a lower surface and a dimension between said upper surface and said lower surface that is shorter than said distance between said underside and said topside so that the central portion does not exert force on the flanges.

13. A support system as in claim 7, wherein said top flange has an underside and said bottom flange has a topside spaced apart from each other a distance, said central portion of the support block has an upper surface and a lower surface and a dimension between said upper surface and said lower surface that is about 1/16 inch shorter than said distance between said underside and said topside so that the central portion does not exert force on the flanges.

14. A support system as in claim 7, wherein said unitary piece is selected from the group consisting of: a solid block of material, veneered material, laminated material, reconstituted material, and composite material.

15. A support system for an end of an I-joist in a floor or rafter system, the support system comprising the I-joist with an end, at least one support block connected to said I-joist at its end, and a rim board attached to said I-joist end and said support block;

wherein the I-joist end has an I-shaped end surface and a side surface, the side surface comprising a central vertical web with a top edge and a bottom edge, a top flange protruding laterally out from said web top edge and having a top flange outermost side extremity, and a bottom flange protruding laterally out from said web bottom edge and having a bottom flange outermost side extremity; and wherein the support block is a unitary piece comprising an integral central portion and outer load-bearing portion, the central portion contacting said web and the outer load-bearing portion extending up along said top flange outermost side extremity and extending down along said bottom flange outermost side extremity;

wherein said support block is connected to said I-joist end by one or more nails extending through the support block and into only the web, so that the support block is not nailed to the top flange and not nailed to the bottom flange; and wherein the rim board is nailed to the I-joist end surface and to an end surface of the support block.

16. A support system as in claim 15, further comprising a horizontal plate on which said I-joist and said support block rest, and toe-nails connecting the support block to the plate, wherein said toe-nails extend through a bottom region of the support block outer load-bearing portion and into the plate at an angle to the outer surface of the load-bearing portion, wherein there are no nails extending from the support block into the bottom flange of the I-joist.

* * * * *